US009414460B2

(12) United States Patent
Bender et al.

(10) Patent No.: US 9,414,460 B2
(45) Date of Patent: Aug. 9, 2016

(54) METHODS AND SYSTEMS FOR CONTROLLING LEDS

(71) Applicant: MELEXIS TECHNOLOGIES NV, Tessenderlo (BE)

(72) Inventors: Michael Bender, Erfurt (DE); Michael Frey, Erfurt (DE)

(73) Assignee: MELEXIS TECHNOLOGIES NV, Tessenderlo (BE)

( * ) Notice: Subject to any disclaimer, the term of this patent is extended or adjusted under 35 U.S.C. 154(b) by 187 days.

(21) Appl. No.: 14/039,688

(22) Filed: Sep. 27, 2013

(65) Prior Publication Data

US 2014/0084811 A1 Mar. 27, 2014

(30) Foreign Application Priority Data

Sep. 27, 2012 (EP) ..... 12186263
Mar. 14, 2013 (GB) ..... 1304663.6

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.
CPC ..... *H05B 33/089* (2013.01)

(58) Field of Classification Search
USPC ..... 315/291–311
See application file for complete search history.

(56) References Cited

U.S. PATENT DOCUMENTS

| | | | | |
|---|---|---|---|---|
| 5,859,658 | A | 1/1999 | Hammond | |
| 6,759,888 | B1 * | 7/2004 | Wodnicki | 327/382 |
| 8,264,171 | B1 * | 9/2012 | Domer | 315/309 |
| 2006/0145969 | A1 * | 7/2006 | Fish et al. | 345/77 |
| 2010/0026203 | A1 * | 2/2010 | Zhao | H05B 33/0815 315/291 |
| 2010/0141153 | A1 * | 6/2010 | Recker et al. | 315/149 |
| 2010/0145645 | A1 | 6/2010 | Gonopolskiy et al. | |
| 2010/0327766 | A1 * | 12/2010 | Recker et al. | 315/291 |
| 2011/0133655 | A1 * | 6/2011 | Recker et al. | 315/159 |
| 2012/0200229 | A1 * | 8/2012 | Kunst | H05B 33/0815 315/186 |
| 2013/0063035 | A1 * | 3/2013 | Baddela | H05B 33/0845 315/192 |
| 2013/0162165 | A1 * | 6/2013 | Saes | 315/224 |
| 2013/0293147 | A1 * | 11/2013 | Rogers et al. | 315/297 |

FOREIGN PATENT DOCUMENTS

| | | | |
|---|---|---|---|
| EP | 2334144 | A1 | 6/2011 |
| WO | 2006092040 | A1 | 9/2006 |
| WO | 2006094590 | A1 | 9/2006 |

* cited by examiner

*Primary Examiner* — Brandon S Cole
(74) *Attorney, Agent, or Firm* — Workman Nydegger

(57) ABSTRACT

The present invention relates to an electronic device, the electronic device comprising at least one LED, a driving unit for applying a driving algorithm for driving the LED during normal operation, and a measurement unit for determining a forward voltage of the LED by imposing a test current to the LED, the measurement unit being programmed for determining test current characteristics taking into account said driving algorithm.

20 Claims, 2 Drawing Sheets

METHODS AND SYSTEMS FOR CONTROLLING LEDS

FIELD OF THE INVENTION

The invention relates to the field of lighting and/or displaying. More specifically it relates to methods and systems for measuring and/or taking into account aging of a lighting element or variation of a lighting element as function of environmental parameters.

BACKGROUND OF THE INVENTION

The use of lighting elements, such as for example LED devices, is widely spread. One known problem of lighting elements is that they are often subject to aging effects. Aging effects refer to effects, such as for example a decrease in emission intensity, of lighting elements as function of the operation time. Furthermore, it is known that environmental conditions also can influence the performance of lighting elements, such as LED devices.

A plurality of techniques are known for compensating for aging effects. European patent application EP 2334144 describes a method of determining ageing characteristics of a LED whereby a current stress pulse is applied. The LED thereby is monitored to determine when the thermal heating induced by the current stress pulse has been dissipated to a desired level. The operational characteristics of the LED are then measured before applying a next stressing pulse. The technique presented typically is a test technique.

U.S. Pat. No. 5,859,658 describes an apparatus for compensating LED printbars for aging wherein changes in the slopes of the forward voltage drop versus forward current characteristics of the LEDs are determined and wherein the drive currents of the LEDs are changed as function of the changes in the slope so as to compensate for changes in the LED light output.

Nevertheless, there is still need for a good techniques for compensating for aging effects for LEDs.

SUMMARY OF THE INVENTION

It is an object of embodiments of the present invention to provide good methods and systems for measuring and/or taking into account aging of one or more LEDs or environmental effects influencing the operation of the one or more LEDs, the methods and systems being accurately applicable during normal driving operation of the one or more LEDs.

It is an advantage of embodiments according to the present invention that aging effects of a LED or environmental effects can be taken into account, during normal driving operation.

It is an advantage of embodiments of the present invention that the information about aging or environmental effects can be used for compensating performance deterioration of the LEDs. It is an advantage of embodiments according to the present invention that aging of LEDs or environmental effects influencing the performance of the LED can be compensated so that these effects are not visible on the performance of the LED, even not when the operation time of the LED becomes long—e.g. even not over the lifetime of the LED.

The above objective is accomplished by a method and device according to the present invention.

In a first aspect, the present invention relates to an electronic device, the electronic device comprising at least one LED, a driving unit for applying a driving algorithm for driving the LED during normal operation, and a measurement unit for determining a forward voltage of the LED by imposing a test current to the LED, the measurement unit being programmed for determining test current characteristics taking into account said driving algorithm.

The measurement unit may be programmed for dynamically adjusting the test current as function of the driving algorithm. The measurement unit may be configured for measuring the forward voltage differentially.

The measuring unit may comprise a differential amplifier for measuring the forward voltage differentially.

The measuring unit may comprise a differential amplifier, a variable current source and an ADC converter, for determining a forward voltage of the LED.

The electronic device may comprise a plurality of different LEDs, wherein a single differential amplifier is configured for measuring the forward voltage differentially for different LEDs.

The differential amplifier may be configured for selecting an input for each LED of a set of LEDs of an RGB LED configuration in the electronic device.

The device may comprise a controller for measuring the forward voltage over different LEDs of a set of LEDs in a sequential manner.

The electronic device furthermore may comprise an offset compensation means for compensating for an offset of the differential amplifier.

The offset compensation means may be a hardware (HW) offset compensation means or software (SW) offset compensation means.

The electronic device furthermore may comprise an adjustment means for adjusting the driving of the LED for compensating for the determined effects due to aging and/or environmental effects.

The differential amplifier may comprise continuous time switched capacitors with integrated offset compensation.

The measurement unit may comprise a differential amplifier circuit comprising a first and second input, the first and the second input of the differential amplifier circuit being connected such that the forward voltage over the LED can be determined from the output of the differential amplifier.

The present invention also relates to a method for measuring and/or compensating environmental effects or aging effects on a LED, the method comprising determining a forward voltage of the LED and using the forward voltage of the LED device for determining environmental effects and/or aging effects.

Determining the forward voltage may comprise differentially measuring the voltage in relation to the voltage where the LED is connected to.

The method may comprise compensating for a change in properties of the LED device related to environmental effects and/or aging effects.

Determining environmental effects may comprise determining an ambient temperature.

The method may comprise distinguishing between different effects based on the rate of change of the performance of the LED device.

The method may comprise distinguishing between different effects by taking into account different performance characteristics.

The method may comprise compensating for each LED of one or more RGB-LED devices.

The present invention also relates to a controller being programmed for performing a method for measuring and/or compensating environmental effects or aging effects on a LED as described above.

In another aspect, the present invention also relates to a measurement unit for use with an electronic device comprising at least one LED and a driving circuit, the measurement unit being programmed for determining a forward voltage of the LED by imposing a test current to the at least one LED and being programmed for determining a test current characteristic taking into account said driving algorithm.

The measurement unit may be programmed for dynamically adjusting the test current as function of the driving algorithm.

The measurement unit may comprise a differential amplifier for measuring the forward voltage differentially.

The measurement unit may comprise a differential amplifier, a variable current source and an ADC converter, for determining a forward voltage of the LED.

The measurement unit may comprise a single differential amplifier being configured for measuring the forward voltage differentially for different LEDs.

The differential amplifier may be configured for selecting an input for each LED of a set of LEDs of an RGB LED configuration in the electronic device.

The measurement unit may comprise an offset compensation means for compensating for an offset of the differential amplifier. The offset compensation means is a hardware (HW) offset compensation means or software (SW) offset compensation means.

The measurement unit may be configured for providing an output signal to an adjustment means for adjusting the driving of the LED for compensating for the determined effects due to aging and/or environmental effects.

The differential amplifier may comprise continuous time switched capacitors with integrated offset compensation.

The measurement unit may comprise a differential amplifier circuit comprising a first and second input, the first and the second input of the differential amplifier circuit being connected such that the forward voltage over the LED can be determined from the output of the differential amplifier.

The present invention also relates to a computer program product and a data carrier comprising a set of instructions for, when executed on a computer, performing a method for measuring and/or compensating environmental effects or aging effects on a LED.

In a further aspect, the present invention may relate to a method for measuring and/or compensating environmental effects or aging effects on a LED, the method comprising determining a forward voltage of the LED and e.g. using the forward voltage of the LED device for determining an environmental effects and/or aging effects.

In one embodiment, determining the forward voltage may be performed by differentially measuring the voltage in relation to the voltage where the LED is connected to.

The method may comprise compensating for a change in properties of the LED device related to environmental effects and/or aging effects. The environmental effect may be an ambient temperature. Distinguishing between different effects may e.g. be performed based on the rate of change of the performance of the LED device, on different performance characteristics taken into account or on other aspects of the performance of the LED.

The method may comprise compensating for each LED of one or more RGB-LED devices.

The present invention also may relate to an electronic device, the electronic device comprising at least one LED and a measurement unit for determining a forward voltage of the LED. The measurement unit may be adapted for measuring the forward voltage. The measurement unit may be adapted for measuring the forward voltage differentially, e.g. using a differential amplifier. In one embodiment, the measuring unit may comprise a differential amplifier, a variable current source and an ADC converter. A single differential amplifier may be used for different LEDs, e.g. for different LEDs of an RGB-LED device. The differential amplifier may be arranged for selecting an input for each LED of a set of LEDs, e.g. in RGB-LEDs. The measurement of the forward voltage over different LEDs of a set of LEDs may be performed sequentially. The electronic device furthermore may comprise an offset compensation means for compensating for an offset of the differential amplifier. Such an offset compensation means may be a hardware (HW) offset compensation means or software (SW) offset compensation means. The system furthermore may comprise an adjustment means for adjusting the driving of the LED for compensating for the determined effects due to aging and/or environmental effects. Such an adjustment means may make use of predetermined algorithms, look up tables or other means for determining the adjustment required for compensating the LED performance for the aging and/or environmental effects Particular and preferred aspects of the invention are set out in the above and below description and examples. Features from one embodiment may be combined with features of other embodiments as appropriate and not merely as explicitly set out.

These and other aspects of the invention will be apparent from and elucidated with reference to the embodiment(s) described hereinafter.

Figure 1:
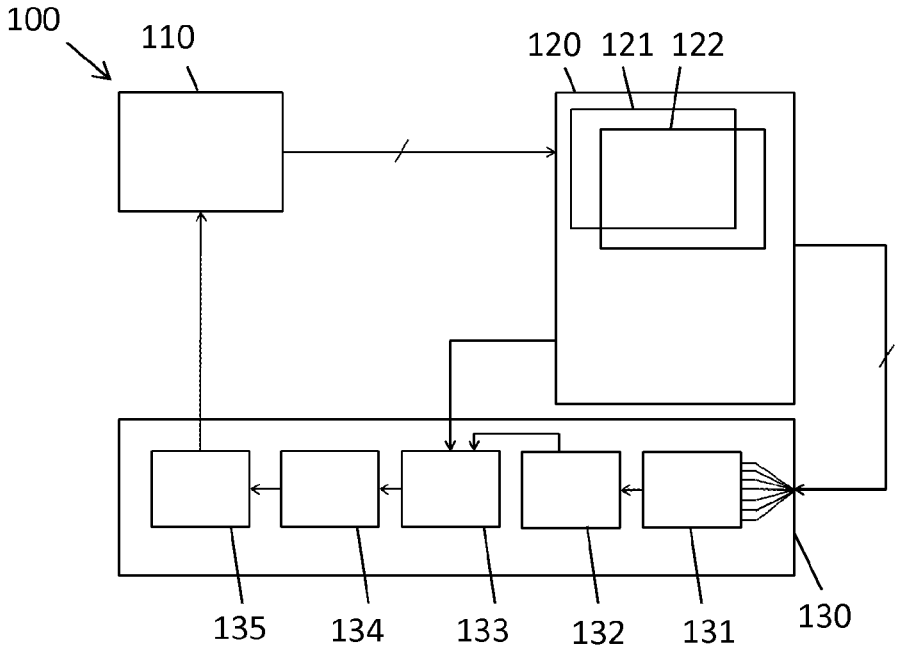
FIG. 1 is a schematic overview of different components and subcomponents, and their interaction, of a system according to an embodiment of the present invention.

The drawings are only schematic and are non-limiting. In the drawings, the size of some of the elements may be exaggerated and not drawn on scale for illustrative purposes.

DETAILED DESCRIPTION OF ILLUSTRATIVE EMBODIMENTS

The terms first, second and the like in the description, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, under and the like in the description are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising" should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the invention requires more features than are expressly recited as essential.

Furthermore, while some embodiments described herein include some but not other features included in other embodiments, combinations of features of different embodiments are meant to be within the scope of the invention, and form different embodiments, as would be understood by those in the art.

Where in embodiments of the present invention reference is made to a driving algorithm, reference may be made to the driving conditions for driving one or more LEDs. Such driving conditions typically may comprise driving times and driving values used for driving the one or more LEDs.

According to embodiments of the present invention, a LED forward voltage is measured, and this may be used for compensating performance effects of the LED due to aging and/or due to environmental factors. It is an advantage of embodiments according to the present invention that the forward voltage of LEDs can be used for the determination of the ambient temperature and that consequently, the influence of environmental effects such as the temperature on the LED properties can be compensated for.

In a first aspect, the present invention relates to an electronic device comprising one or more LEDs and a driving unit for driving the one or more LEDs according to a driving algorithm—which may be different over time and between different LEDs—during normal operation. The device also comprises a measurement unit for determining a forward voltage of the LED by imposing a test current to the LED, the measurement unit being programmed for determining test current characteristics taking into account said driving algorithm.

Figure 2:
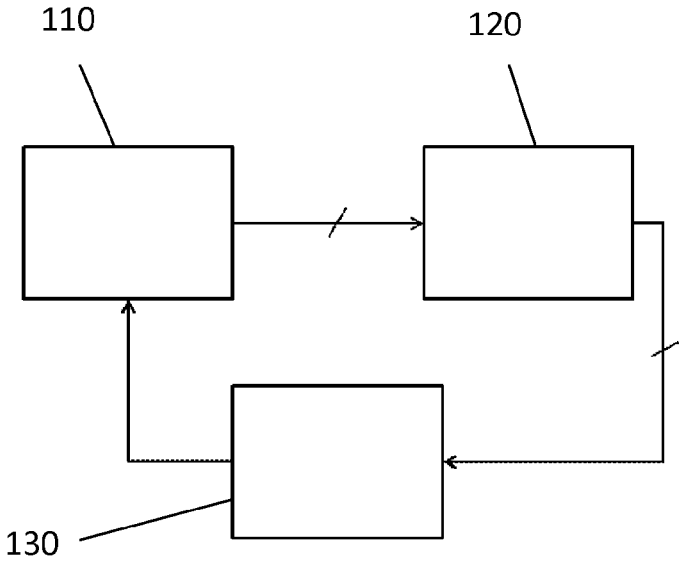
FIG. 2 is a schematic overview of different components, and their interaction, of a system according to an embodiment of the present invention.

By way of illustration, an exemplary embodiment of such an electronic device 100 is shown in FIG. 1, where the LED configuration 120—driven using a driving unit 110—interfaces with the measurement unit 130 through a parallel interface. This interface enables the measurement unit to select a LED, set a current through the selected LED, and measure the forward voltage over the selected LED. The measurement unit 120 on its turn interfaces with the driving means 110 for adjusting the driving means such that during operation mode aging effects are taken into account. In the exemplary embodiment of FIG. 2 the subcomponents of an embodiment of the current invention, as well as their interaction, are shown. The driving unit 110 drives the individual LEDs of the LED configuration. In the exemplary embodiment a first LED 121 and a second LED 122 are shown. The LED configuration interfaces with the measurement unit 130. The selector 131 of the measurement unit 130 can select the interface of one of the LEDs. Once selected, the variable current source 132 can set a current through the selected LED. In embodiments of the current invention the measurement current through the LED is smaller, e.g. smaller than 50% of, e.g. smaller than 25% of, e.g. smaller than 10%, e.g. smaller than 5% of the current during normal operating mode. The measurement only takes place during a limited amount of time in order not to disturb the normal operating mode at max. 16-bit resolution. Through a differential amplifier with switched capacitors, also referred to as differential amplifier circuit 133, the voltage over the selected LED is amplified and fed to an AD convertor system 134 which converts the signal and feeds it to a processing means 135. The measured voltage can be converted into the forward voltage of the LED by the processing means 135. Based on the measured forward voltage, the processing means 135 can determine an adjustment for adjusting the driving unit 110 such that aging effects of the LED are taken into account during operating mode.

Figure 3:
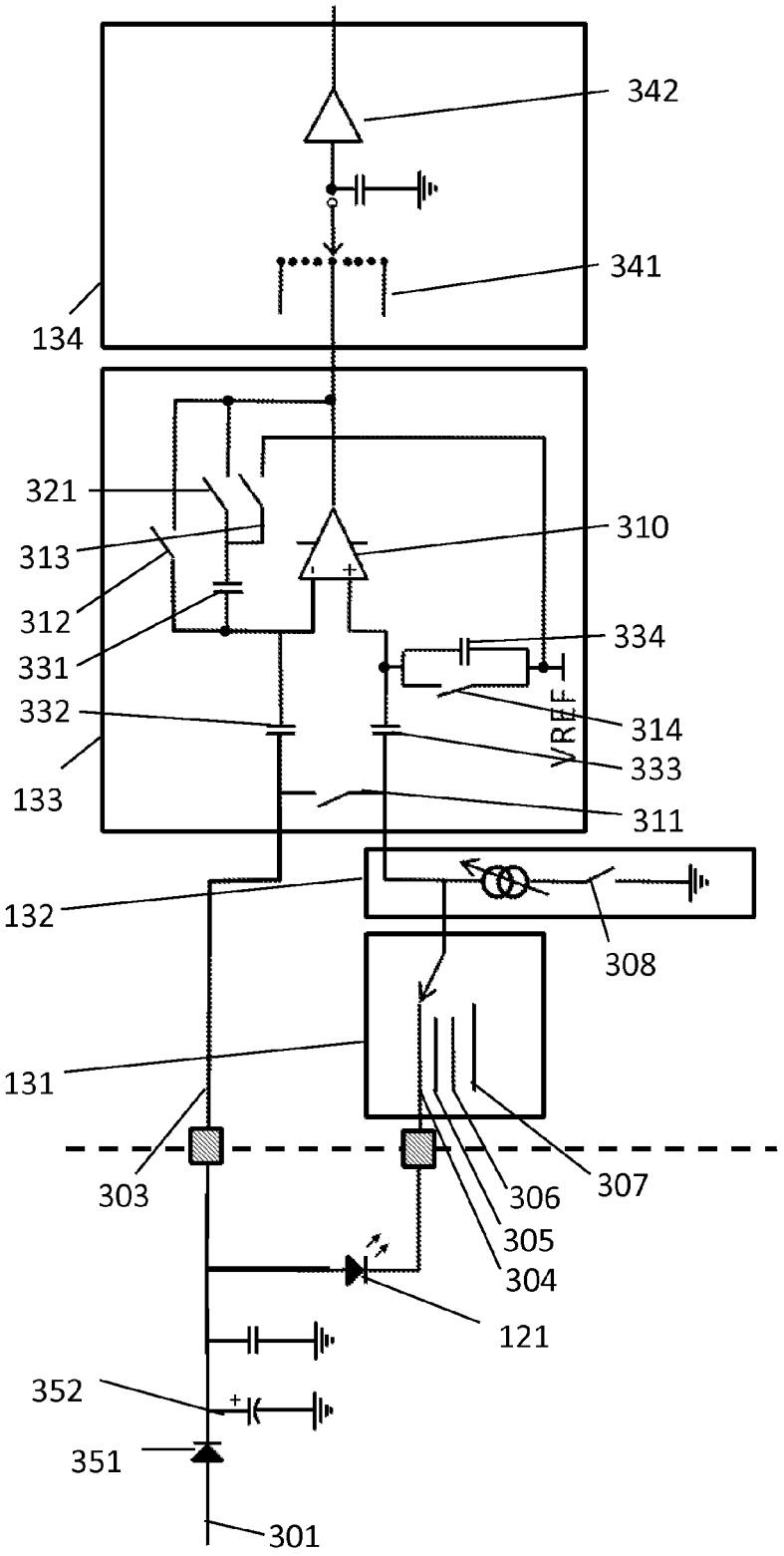
FIG. 3 illustrates an example of a configuration wherein the forward voltage of a LED can be measured, according to an embodiment of the present invention.

Further by way of illustration, the present invention not being limited thereto, an exemplary device is further described below, embodiments of the present invention not being limited thereto. The forward voltage of an LED can in one example be differential measured in relation to the voltage where the LED is connected to. The following figure is showing such kind of concept. The differential amplifier comprises continuous time switched capacitors with integrated offset compensation. FIG. 3 illustrates one example of a device comprising a LED and comprising a measurement unit for determining an effect of an aging and/or environmental factor.

The exemplary embodiment of FIG. 3 shows in more detail a possible implementation of the measurement unit. A battery 301 is used to power the LED 121. In between the battery 301 and the LED 121 is a protection diode 351. An input protection capacity 352 protects against pulses in an automotive environment The selector 131 can select between different input channels HVIO0 304, HVIO1 305, HVIO2 306, HVIO3 307.

The differential amplifier 310 with switched capacitors 133 connects with VS 303 and with HVIO0 304 (since HVIO0 is selected by the selector 132). The selector 132 typically may comprise a source enable element for enabling the current source.

More particularly, in one example, capacitor C2 332 connects VS with the first input of the differential amplifier. Capacitor C3 333 connects HVIO0 with the second input of the differential amplifier. A switch CP1 311 between VS and HVIO0 is used for offset scaling. Capacitor C1 331 connects the first input of the differential amplifier with the output of the differential amplifier, provided the switch CP2 321 is closed. When switch CP1 313 is closed, capacitor C1 331 connects the first input of the differential amplifier with a reference voltage Vref. When switch CP1 312 is closed the first input of the differential amplifier is connected with the output of the differential amplifier. Capacitor C4 334 interconnect the second input of the differential amplifier with a reference voltage Vref. When switch CP1 314 is closed, the second input of the differential amplifier is directly connected with a reference voltage Vref.

In FIG. 3, the differential amplifier circuit thus comprises a first capacitor 331, comprising a first and a second node, the first node connected to the first input of the amplifier circuit, the second node connected to a first switch 321 that also connects to the output of the differential amplifier.

The differential amplifier circuit comprises a second capacitor 332, comprising a first and a second node, the second node connected with the first input of the differential amplifier, the first node being the first input of the differential amplifier circuit.

The differential amplifier circuit comprises a third capacitor 333, comprising a first and a second node, the second node connected with the second input of the differential amplifier, the second node being the second input of the amplifier circuit, The differential amplifier circuit a fourth capacitor 334, comprising a first and a second node, the first node connected with the second input of the differential amplifier, the second node connected with a reference voltage.

The differential amplifier circuit a first switch 311 that, when closed, interconnects the first node of the second capacitor and the first node of the third capacitor.

The differential amplifier circuit a second switch 312 that, when closed, interconnects the first input of the differential amplifier with the output of the differential amplifier, The differential amplifier circuit a third switch 313 that, when closed, interconnects the second node of the first capacitor 331 with the reference voltage.

The differential amplifier circuit a fourth switch 314 that, when closed, interconnects the second node of the differential amplifier with the reference voltage.

The differential amplifier circuit a fifth switch 321 that, when closed, interconnects the second node of the first capacitor 331 with the output of the differential amplifier.

The output signal of the differential amplifier circuit is outputted to the ADC converter system 134, which comprises an AD channel selector and the actual AD converter.

It can be seen in FIG. 3 that the LED is connected to voltage source VS. Voltage source VS corresponds with a voltage similar to the battery voltage $V_{bat}$ but with a polarity protection $V_{protection_diode}$ included: $VS=V_{bat}-V_{protection_diode}$ The forward voltage of the LED is measured between VS and the LED itself. The current through the LED typically is adjusted and limited via the internal current source. The internal current source is variable. Because of that, the forward voltage of the LED can be calculated as in the following:

$$U_{LED}=(U_{VS}-U_{HVIOx})$$

wherein $U_{LED}$ is the forward voltage of the LED, $U_{VS}$ is the voltage over the voltage source VS $U_{HVIOx}$ is the voltage at the internal current source connected to HVIO.

Differential Amplifier

The internal current source is calibrated during final test. Therefore, the adjusted current of the current source is well-known. ($U_{VS}-U_{HVIOx}$) is not known and must be internally measured. The measurement is done via an internal differential amplifier and the ADC.

The calculation of the differential amplifier looks like in the following where the Cs are considered as resistors to keep it as simple as possible:

$$U_{diff_out} = \frac{(C1 + C2) * (U_{HVIOx} * C4 + U_{VREF} * C3)}{C2 * (C3 + C4)} - \frac{U_{VS} * C1}{C2}$$

The given formula can be simplified for C1=C4 and C2=C3:

$$U_{diff_out} = (U_{HVIOx} - U_{VS})\frac{C1}{C2} + U_{VREF}$$

In case, the difference between $U_{VS}$ and $U_{HVIOx}$ is 0 then there remains the common mode voltage $U_{VREF}$. C1/C2 can be considered as gain-factor of the differential amplifier.

EXAMPLE CALCULATION FOR THE ACCURACY OF THE LED FORWARD VOLTAGE

The gain-factor of the differential amplifier is in the present example given by factor 1/5. Furthermore, $U_{VREF}$ is 1.25V. As a result, the inputs of the differential amplifier can have a difference of 0 . . . 6.25V (maximum: $U_{VREF}$/gain). The internal ADC reference voltage is given by 1.5V for getting the highest accuracy over the complete output range of the differential amplifier (0 . . . 1.25V→UVREF).

In this case, the resolution of the measurable LED forward voltage is ~7.33 mV per ADC digit where the ADC has a resolution of 10 Bit (5*1.5V/1023→ADCreference_voltage/(ADCresolution*gain)). Let's assume a temperature coefficient of ~−3.7 mV for the LED. It allows a maximum measurable temperature resolution of ~2-3 K.

Result

The forward voltage of an RGB-LED can be differential measured. Therefore, a single differential amplifier, a variable current source and an ADC must be available. The input of the differential amplifier can be selected for each LED of the RGB-LED (see FIG. 1). Therefore, the measurement of the forward voltage over the three LEDs must be done sequentially. Alternatively, different differential amplifiers could be used for example. The offset of the differential amplifier can be compensated by HW and/or SW where the differential amplifier with SC-Technology can fully handle the offset compensation in HW. The total resolution obtained in some devices is ~7.33 mV per ADC digit. Moreover, the maximum difference between VS and HVIOx (protection resistor+LED) can be 6.25V.

In one aspect, the present invention also relates to a measurement unit as described above, while describing the electronic device. Such a measurement unit therefore does not need to be part of the electronic device, but at least is suitable for determining an aging or environmental effect of one or more LEDs in an electronic device comprising a driving unit. The measurement unit thus may be configured for co-operating with the electronic device. Specific features of the measurement unit may correspond with features of the measurement unit described with reference to the first aspect.

In yet another aspect, the present invention also relates to a controller being programmed for performing a method for measuring and/or compensating environmental effects or aging effects on a LED. According to embodiments of the present invention, the controller is adapted for performing the method for measuring and/or compensating as described above. The controller may comprise software and/or hardware components for controlling the measuring and/or compensating of environmental or aging effects on the LED.

In yet a further aspect, the present invention also relates to a method for measuring and/or compensating environmental effects or aging effects on a LED implemented as a computer implemented invention in a processor and to corresponding processors, e.g. a controller. One configuration of such a processor may for example include at least one programmable computing component coupled to a memory subsystem that includes at least one form of memory, e.g., RAM, ROM, and so forth. It is to be noted that the computing component or computing components may be a general purpose, or a special purpose computing component, and may be for inclusion in a device, e.g., a chip that has other components that perform other functions. Thus, one or more aspects of the present invention can be implemented in digital electronic circuitry, or in computer hardware, firmware, software, or in combinations of them. For example, each of the method steps may be a computer implemented step. Thus, while a processor as such is prior art, a system that includes the instructions to implement aspects of the method for measuring and/or compensating environmental effects or aging effects on a LED is not prior art.

The present invention thus also includes a computer program product which provides the functionality of any of the methods according to the present invention when executed on a computing device.

In another aspect, the present invention relates to a data carrier for carrying a computer program product for measuring and/or compensating environmental effects or aging effects on a LED. Such a data carrier may comprise a computer program product tangibly embodied thereon and may carry machine-readable code for execution by a programmable processor. The present invention thus relates to a carrier medium carrying a computer program product that, when executed on computing means, provides instructions for executing any of the methods as described above. The term "carrier medium" refers to any medium that participates in providing instructions to a processor for execution. Such a medium may take many forms, including but not limited to, non-volatile media, and transmission media. Non-volatile media includes, for example, optical or magnetic disks, such as a storage device which is part of mass storage. Common forms of computer readable media include, a CD-ROM, a DVD, a flexible disk or floppy disk, a tape, a memory chip or cartridge or any other medium from which a computer can read. Various forms of computer readable media may be involved in carrying one or more sequences of one or more instructions to a processor for execution. The computer program product can also be transmitted via a carrier wave in a network, such as a LAN, a WAN or the Internet. Transmission media can take the form of acoustic or light waves, such as those generated during radio wave and infrared data communications. Transmission media include coaxial cables, copper wire and fibre optics, including the wires that comprise a bus within a computer.

The invention claimed is:

1. An electronic device, the electronic device comprising:

a plurality of LEDs, a driving unit for applying a driving algorithm for driving said plurality of LEDs during normal operation, and a measurement unit comprising an internal current source connectable, one at a time, to each LED of the plurality of LEDs, the measurement unit being adapted for determining a separate forward voltage of each LED by super-imposing a test current of said internal current source to each LED, one at a time, during a limited amount of time in order not to disturb normal operation, the measurement unit being programmed for determining test current characteristics for each LED, taking into account said driving algorithm.

2. An electronic device according to claim 1, the measurement unit being programmed for dynamically adjusting the test current as a function of the driving algorithm.

3. An electronic device according to claim 1, wherein the measurement unit comprises a differential amplifier for measuring the forward voltage of each LED differentially.

4. An electronic device according to claim 3, wherein the electronic device furthermore comprises an offset compensation means for compensating for an offset of the differential amplifier.

5. An electronic device according to claim 4, wherein the offset compensation means is a hardware offset compensation means or software offset compensation means.

6. An electronic device according to claim 3, wherein the differential amplifier comprises continuous time switched capacitors with integrated offset compensation.

7. An electronic device according to claim 3, wherein the current source is a variable current source, and wherein the measurement unit further comprises an ADC converter for determining the forward voltage of each LED.

8. An electronic device according to claim 3, wherein the plurality of LEDs is a set of LEDs of an RGB LED configuration, and wherein the differential amplifier is configured for selecting an input for each LED of the plurality of LEDs.

9. An electronic device according to claim 1, wherein the electronic device comprises a controller for determining the forward voltage over each LED, one at a time, in a sequential manner.

10. An electronic device according to claim 1, the electronic device furthermore comprising an adjustment means for adjusting the driving of each LED for compensating for the determined effects due to aging and/or environmental effects.

11. An electronic device according to claim 1, wherein the measurement unit comprises a differential amplifier circuit comprising a first input and a second input, the first and the second inputs of the differential amplifier circuit being connectable to each LED, one at a time, such that the forward voltage over each LED can be determined, one at a time, from the output of the differential amplifier.

12. A method for measuring and/or compensating for environmental effects or aging effects on each of a plurality of LEDs, the method comprising:

driving the plurality of LEDs by applying a driving algorithm;

connecting each LED of said plurality of LEDs to a current source, one at a time, for super-imposing a test current to each LED, one at a time, during a limited amount of time in order not to disturb normal operation;

determining a separate forward voltage of each LED; and for each LED, using the forward voltage of the LED for determining environmental effects and/or aging effects on the LED.

13. A method according to claim 12, wherein determining the forward voltage of each LED comprises differentially measuring the forward voltage in relation to a voltage where the LED is connected to.

14. A method according to claim 12, wherein the method further comprises compensating for a change in properties of each LED related to environmental effects and/or aging effects.

15. A method according to claim 12, wherein determining environmental effects comprises determining an ambient temperature.

16. A method according to claim 12, wherein the method comprises distinguishing between different effects based on a rate of change of the performance of each LED.

17. A method according to claim 12, wherein the method comprises distinguishing between different effects by taking into account different performance characteristics of each LED.

18. A method according to claim 12, wherein the method comprises measuring and compensating for each LED of one or more RGB-LED devices.

19. A controller being programmed for performing a method for measuring and/or compensating for environmental effects or aging effects on a plurality of LEDs according to claim 12.

20. An electronic device, the electronic device comprising:

a plurality of LEDs comprising at least one individual LED, a driving unit for applying a driving algorithm for driving said plurality of LEDs during normal operation, and a measurement unit comprising an internal current source coillessly connectable to the individual LED through a single component being a switch, adapted for super-imposing a test current to each LED, one at a time, during a limited amount of time in order not to disturb normal operation, the measurement unit being adapted for determining a forward voltage of said individual LED by imposing a test current of said internal current source to said individual LED, the measurement unit being programmed for determining test current characteristics taking into account said driving algorithm.

* * * * *